United States Patent [19]

Yatabe et al.

[11] Patent Number: 4,694,805

[45] Date of Patent: Sep. 22, 1987

[54] AIR-FUEL RATIO CONTROL METHOD FOR INTERNAL COMBUSTION ENGINES

[75] Inventors: Fumio Yatabe; Yoshio Wazaki, both of Wako, Japan

[73] Assignee: Honda Giken Kogyo K.K., Tokyo, Japan

[21] Appl. No.: 908,310

[22] Filed: Sep. 17, 1986

[30] Foreign Application Priority Data

Sep. 19, 1985 [JP] Japan ..... 60-207292
Sep. 19, 1985 [JP] Japan ..... 60-207293

[51] Int. Cl.[4] ..... F02D 41/14
[52] U.S. Cl. ..... 123/489
[58] Field of Search ..... 123/440, 489

[56] References Cited

U.S. PATENT DOCUMENTS

| | | | |
|---|---|---|---|
| 4,357,828 | 11/1982 | Nakano | 123/440 X |
| 4,391,130 | 7/1983 | Nakano et al. | 123/489 X |
| 4,392,471 | 7/1983 | Miyagi et al. | 123/489 |
| 4,517,949 | 5/1985 | Ito et al. | 123/489 |
| 4,552,115 | 11/1985 | Okino | 123/489 |
| 4,615,319 | 10/1986 | Tomisawa | 123/440 |

*Primary Examiner*—Willis R. Wolfe, Jr.

*Attorney, Agent, or Firm*—Arthur L. Lessler

[57] ABSTRACT

A method of effecting feedback control of the air-fuel ratio of an air-fuel mixture being supplied to an internal combustion engine, by correcting a basic fuel supply quantity by the use of a correction coefficient variable in response to the output of an exhaust gas ingredient concentration sensor. An engine low-load operating region is defined by at least one parameter representing load on the engine. When the engine enters the low-load operating region, a value of the correction coefficient is determined in response to an output from the above sensor and also an average value of values of the correction coefficient thus determined is calculated for a predetermined time period after the engine enters the low-load operating region. A target value of the correction coefficient is calculated on the basis of the average value obtained, the target value yielding a predetermined air-fuel ratio higher than a stoichiometric mixture ratio. The value of the correction coefficient is varied after the lapse of the predetermined time period and until it becomes equal to the target value while the engine remains in the low-load operating region. The basic fuel supply quantity is corrected by the use of the value of the correction coefficient thus varied.

9 Claims, 6 Drawing Figures

| |
|---|
| FIG.5A |
| FIG.5B |

AIR-FUEL RATIO CONTROL METHOD FOR INTERNAL COMBUSTION ENGINES

BACKGROUND OF THE INVENTION

This invention relates to a control method of controlling the air-fuel ratio of an air-fuel mixture being supplied to an internal combustion engine, and more particularly to a method of this kind which can improve the engine driveability and emission characteristics when the engine is operating in a low load operating region wherein feedback control should be interruped.

An air-fuel ratio control method for an internal combustion engine is generally known wherein the fuel quantity supplied to the engine is controlled in a feedback manner responsive to an output signal from an exahust gas sensor which detects the concentration of an exhaust gas ingredient, in order that the air-fuel ratio of the mixture supplied to the engine becomes equal to a desired ratio (e.g. the stoichiometric mixture ratio).

It is also known e.g. from Japanese Provisional Patent Publication (Kokai) No. 59-539 to provide mixture-leaning regions which are defined by engine operation parameters (e.g. vehicle speed, engine coolant temperature, intake pipe absolute pressure, engine rotational speed), and control the air-fuel ratio of the mixture supplied to the engine to a value larger or leaner than the stoichiometric mixture ratio while interrupting the feedback control when the engine is operating in any of the mixture-leaning regions, to thereby reduce the fuel consumption. The leaning of the mixture is effected by multiplying a basic value of fuel supply quantity determined by intake pipe absolute pressure, engine rotational speed, etc. by a mixture-leaning correction coefficient having a fixed value.

The mixture-leaning regions usually include a low-load high speed operation region. In this region, if the basic value of fuel supply quantity is multiplied by a fixed mixture-leaning coefficient as is done in the conventional method, there is a fear that the air-fuel ratio becomes excessively leaner than the desired lean value or excessively richer (about 16) than the latter when there is a deviation of the basic value of fuel supply quantity from a proper value, which results in such problems as poor driveability due to engine output shortage, or high NOx concentration in the exhaust gases.

Japanese Provisional Patent Publication No. 59-539 also discloses that when the engine coolant temperature as the engine temperature is lower than a predetermined value the engine operating region wherein mixture-leaning is effected is made narrower so as to avoid degradation of the emission characteristics as well as degradation of the driveability due to mixture-leaning. However, at low ambient temperature and hence at low engine intake air temperature, injected fuel is not atomized to a sufficient degree, which results in poor combustion of the mixture even if the engine coolant temperature is high, and consequent emission of large amounts of CO and HC. If the mixture is leaned under this poor combustion condition the engine output will be too low to obtain required vehicle driveability. Any conventional methods have been unable to solve these problems.

SUMMARY OF THE INVENTION

It is an object of the invention to provide an air-fuel ratio control method for an internal combustion engine, which is capable of accurately controlling the air-fuel ratio to a desired value to improve the engine driveability and emission characteristics when the engine is in the low-load operating region.

It is another object of the invention to provide an air-fuel ratio control method for an internal combustion engine, which is capable of controlling the mixture leaning in response to engine intake air temperature to improve the engine driveability and emission characteristics when the engine is in the low-load operating region.

The present invention provides a method of effecting control of the air-fuel ratio of an air-fuel mixture being supplied to an internal combustion engine having an exhaust pipe and an exhaust gas ingredient concentration detecting means arranged in the exhaust pipe, by correcting a basic fuel supply quantity by the use of a correction coefficient variable in value in response to an output from the means for detecting the exhaust gas ingredient concentration, the method comprising the steps of: (1) providing a low-load operating region of the engine defined by at least one parameter representing load on the engine; (2) determining, when the engine enters the low-load operating region, a value of the correction coefficient in response to the output from the means for detecting the exhaust gas ingredient concentration and also calculating an average value of values of the correction coefficient thus determined, for a predetermined period of time after the engine enters the low-load operating region; (3) calculating a target value of the correction coefficient on the basis of the average value obtained in the step (2), the target value yielding a predetermined air-fuel ratio leaner than a stoichiometric mixture ratio; (4) varying the value of the correction coefficient after the lapse of the predetermined period of time and until it becomes equal to the target value while the engine remains in the low-load operating region; and (5) correcting the basic fuel supply quantity by the use of the value of the correction coefficient thus varied.

More preferably, in the above step (2) the air-fuel ratio is controlled in a feedback manner responsive to the value of the correction coefficient determined at the step (2) in response to the output from the means for detecting the exhaust gas ingredient concentration, and at the same time the average value of the correction coefficient is calculated.

Still more preferably, the calculation of the average value of the correction coefficient at the step (2) is started when a second predetermined period of time has elapsed since the engine enters the low-load operating region.

Further preferably, the steps (2) through (5) are executed when engine coolant temperature and engine intake air temperature are higher than respective predetermined values.

Still more preferably, the predetermined low-load operating region is a low-load high speed operating region wherein the speed of a vehicle in which the engine is installed is higher than a predetermined value.

The above and other objects, features and advantages of the invention will be more apparent from the ensuing detailed description taken in conjunction with the accompanying drawings.

DETAILED DESCRIPTION

The invention will now be described in detail with reference to the drawings illustrating an embodiment thereof.

Figure 1:
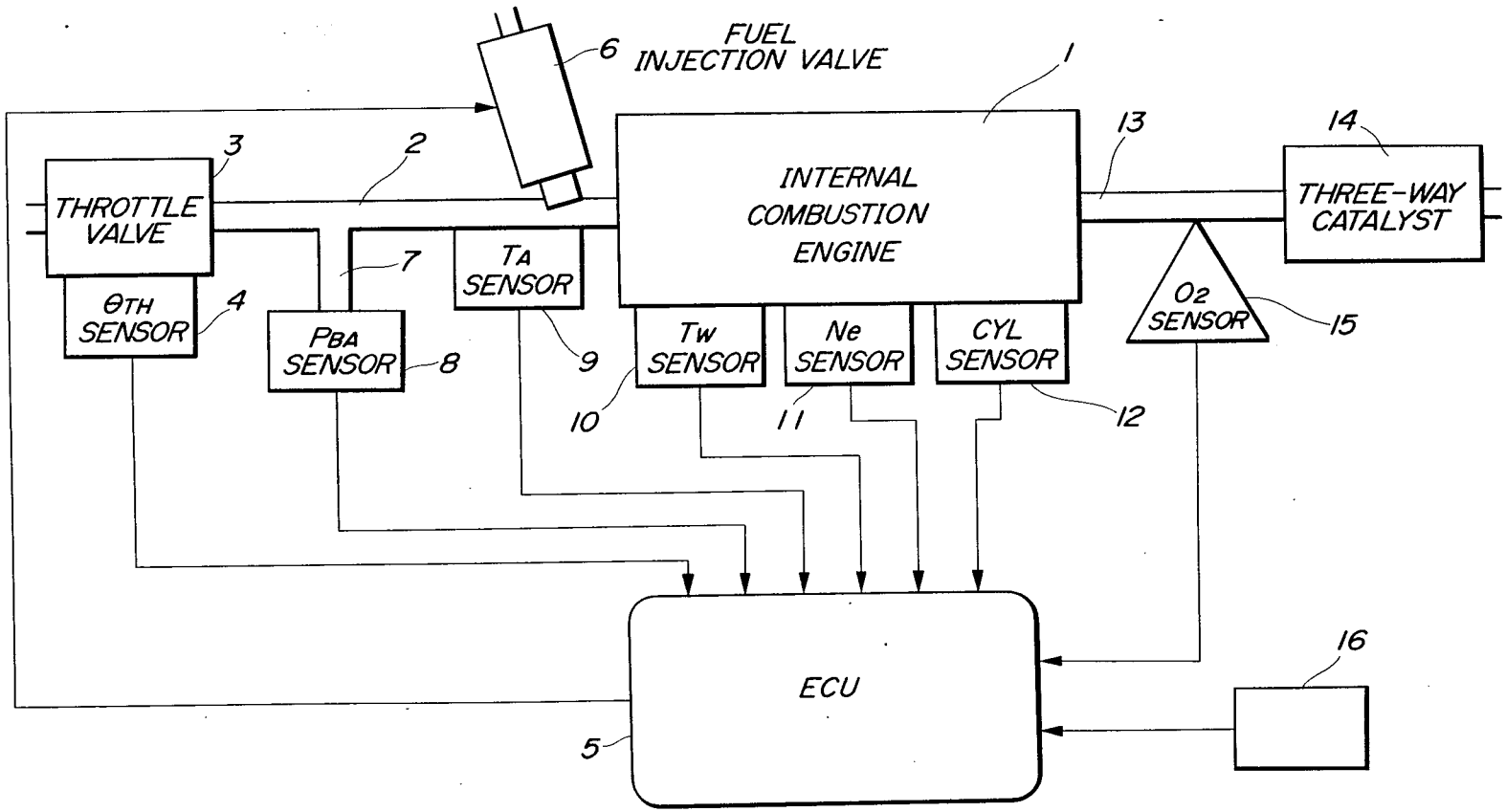
FIG. 1 is a block diagram illustrating the whole arrangement of a fuel supply control system to which is applied the air-fuel ratio control method according to the invention.

Referring first to FIG. 1, there is illustrated the whole arrangement of a fuel supply control system for internal combustion engines, to which the method of the invention is applied. Reference numeral 1 designates an internal combustion engine which may be a four-cylinder type, for instance. Connected to the engine 1 is an intake pipe 2, in which is arranged a throttle valve 3, to which is coupled a throttle valve opening sensor 4 for detecting the throttle valve opening ΘTH and supplying an electrical signal indicative thereof to an electronic control unit (hereinafter called "the ECU") 5, which executes programs for controlling the air-fuel ratio, etc. as described later.

Fuel injection valves 6, one for each cylinder, are arranged in the intake pipe 2 at a location between the engine 1 and the throttle valve 3. These injection valves 6 are connected to a fuel pump, not shown, and also electrically connected to the ECU 5 in a manner having their valve opening periods or fuel injection quantities controlled by driving signals supplied from the ECU 5.

On the other hand, an intake pipe absolute pressure sensor 8 is connected to the intake pipe 2 such that it communicates through a conduit 7 with the interior of the intake pipe 2 at a location between the throttle valve 3 and the fuel injection valves 6. The absolute pressure sensor 8 is adapted to detect absolute pressure PB in the intake pipe 2 via the conduit 7 and supplies an electrical signal indicative of detected absolute pressure to the ECU 5. An intake air temperature sensor 9 for detecting intake air temperature TA is arranged in the intake pipe 2 at a location between the conduit 7 and the fuel injection valves 6, and is also electrically connected to the ECU 5 for supplying same with an electrical signal indicative of detected intake air temperature.

An engine coolant temperature sensor 10, which may be formed of a thermistor or the like, is embedded in the peripheral wall of an engine cylinder having its interior filled with cooling water, to detect engine cooling water temperature TW. An electrical output signal indicative of detected engine cooling water temperature is supplied to the ECU 5.

An engine rotational angle position sensor 11 (hereinafter called "the Ne sensor") and a cylinder-discriminating (CYL) sensor 12 are arranged in facing relation to a camshaft, not shown, of the engine 1 or a crankshaft, not shown, of same. The former 11 is adapted to generate one pulse at each of particular crank angles of the engine each time the engine crankshaft rotates through 180 degrees, as a top-dead-center position (TDC) signal, while the latter 12 is adapted to generate one pulse of a cylinder-discriminating signal at a particular crank angle of a particular engine cylinder. The above pulses generated by the sensors 11, 12 are supplied to the ECU 5.

A three-way catalyst 14 is arranged in an exhaust pipe 13 extending from the engine 1 for purifying ingredients HC, CO, and NOx contained in the exhaust gases. An $O_2$ sensor 15 is inserted in the exhaust pipe 13 at a location upstream of the three-way catalyst 14 for detecting the concentration of oxygen (O2) in the exhaust gases and supplying an electrical signal indicative of the detected oxygen (O2) concentration value to the ECU 5.

Further connected to the ECU 5 are other engine operation parameter sensors, e.g. a vehicle speed sensor 16, for supplying electrical signals indicative of detected values of their respective operation parameters to the ECU 5.

The ECU 5 determines operating regions wherein the engine is operating, e.g. low-load operating regions where the air-fuel mixture is to be made leaner, and calculates, in synchronism with inputting of the TDC signal to the ECU, a fuel injection period TOUT based on various engine operation parameter signals inputted to the ECU 5 as stated above, by the use of the following equation:

$$TOUT = Ti \times KO2 \times KLS \times K1 + K2 \quad (1)$$

where Ti represents a basic value of the fuel injection period of the fuel injection valves 6 which is determined as a function of engine speed Ne detected by the Ne sensor 11 and intake pipe absolute pressure PB detected by the intake pipe absolute pressure sensor 8, and KO2 an air-fuel ratio correction coefficient which is determined based on oxygen concentration detected by the O2 sensor 15 during air-fuel ratio feedback control or determined in a manner hereinafter described during air-fuel ratio open loop control. KLS is a mixture-leaning coefficient which is set to predetermined values in a manner hereinafter described when the engine is in predetermined leaning operating regions. K1 and K2 are other correction coefficients and correction variables, respectively, which are calculated as functions of engine operation parameter values detected by various sensors mentioned before, namely throttle valve opening sensor 4, intake pipe absolute pressure sensor 8, intake air temperature sensor 9, engine coolant temperature sensor 10, Ne sensor 11, cylinder-discriminating sensor 12, O2 sensor 15, and vehicle speed sensor 16, by the use of respective predetermined equations to such values as to optimize various operating characteristics of the engine such as startability, emission characteristics, fuel consumption, and accelerability.

The ECU 5 supplies the fuel injection valves 6 with driving signals corresponding to the fuel injection period TOUT obtained through the equation (1), to thereby open the fuel injection valves 6 over the valve opening period.

Figure 2:
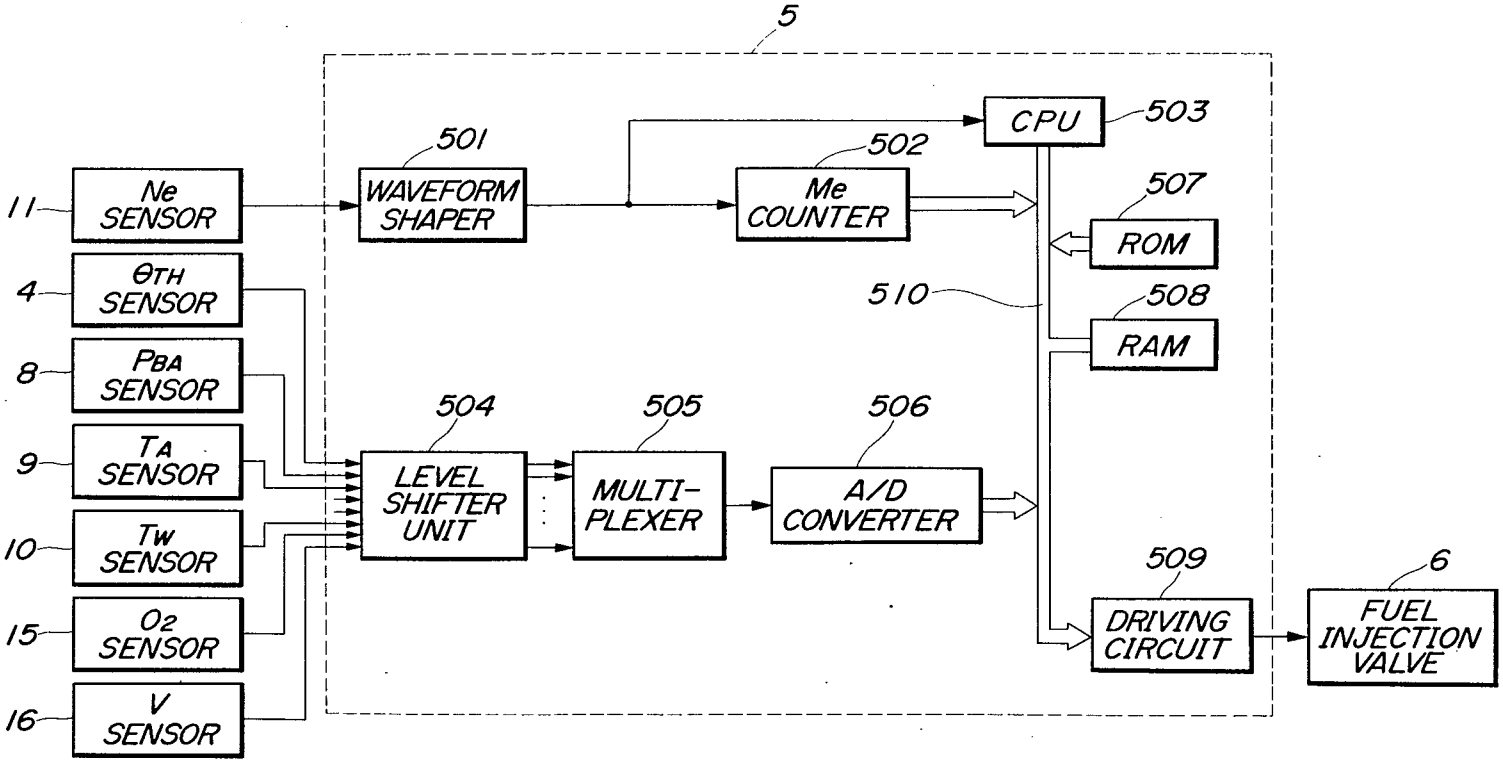
FIG. 2 is a block diagram illustrating the internal arrangement of an electronic control unit (ECU) appearing in FIG. 1.

FIG. 2 shows a circuit arrangement within the ECU 5 in FIG. 1. A TDC signal from the Ne sensor 11 in FIG. 1 is applied to a waveform shaper 501, wherein it has its pulse waveform shaped, and supplied to a central processing unit (hereinafter called "the CPU") 503, as well as to an Me counter 502. The Me counter 502 counts the interval of time between a preceding pulse of the TDC signal and a present pulse thereof, and therefore its counted value Me is proportional to the reciprocal of the actual engine speed Ne. The Me counter 502 supplies the counted value Me to the CPU 503 via a data bus 510.

The respective output signals from various sensors shown in FIG. 1, such as throttle valve opening sensor 4, intake pipe absolute pressure sensor 8, intake air temperature sensor 9, engine coolant temperature sensor 10, and O2 sensor 15 have their voltage levels shifted to a predetermined voltage level by a level shifter unit 504 and then successively applied to an A/D (analog-to-digital) converter 506 through a multiplexer 505.

The A/D converter 506 successively converts the analog output signals from the aforementioned various sensors into digital signals, and the resulting digital signals are supplied to the CPU 503 via the data bus 510.

Further connected to the CPU 503 via the data bus 510 are a read-only memory (hereinafter called "the ROM") 507, a random access memory (hereinafter called "the RAM") 508 and a driving circuit 509. The RAM 507 stores various programs to be executed within the CPU 503, a PB-Ne-Ti map from which the basic fuel injection period Ti is selected, and other various data and tables. The RAM 508 temporarily stores the results of calculations executed within the CPU 503, and other data such as ones read from the Me counter 502 and the A/D converter 506. The driving circuit 509 supplies driving signals corresponding to the fuel injection period TOUT calculated by the equation (1) to the fuel injection valves 6 to drive same.

Figure 3:
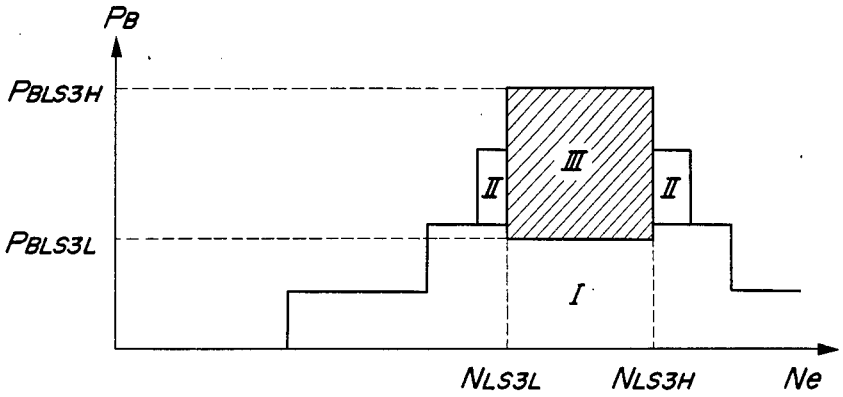
FIG. 3 is a graph showing a mixture-leaning operating region.

Referring to FIG. 3, mixture-leaning regions of the engine are shown, which comprise three regions I, II, and III, divided by the engine rotational speed Ne and the intake pipe absolute pressure PB. The mixture-leaning coefficient KLS is applied as the engine enters these regions. In these mixture-leaning regions, whether or not to effect mixture-leaning is decided based on the speed V of a vehicle in which the engine is installed, the engine coolant temperature TW, and the engine intake air temperature TA. For example, the region III (low load, high speed operating region) is a region where NLS3L<Ne<NLS3H and PBLS3L<PB<PBLS3H hold, and mixture-leaning is effected only when the following conditions are satisfied: V>VLS (e.g 45 km/h), TW>TWLS (e.g. 70° C.), TA>TALS (e.g. 20° C.). The region III corresponds to the vehicle's high speed cruising.

When the engine is in the mixture-leaning region I, the mixture-leaning correction coefficient KLS is set to a predetermined value XLS1 (e.g. 0.90), and when the engine is in the mixture-leaning region II, the coefficient KLS is set to a predetermined value XLS2 (e.g. 0.85), so that the mixture is leaned to air-fuel ratios suitable to the respective regions.

In the regions I and II, the air-fuel ratio correction coefficient KO2 is set to a value KREF which is an average of values of KO2 obtained while the engine was in air-fuel ratio feedback regions (not shown) which lie outside the regions I, II, III. In the region III (the low load, high speed operating region), the mixture-leaning coefficient KLS is set to 1.0 and the air-fuel ratio correction coefficient KO2 is calculated by the following equation:

$$KO2 = KO2AVE \times XLS3 = KO2LLM \quad (2)$$

where KO2AVE is an average of values of the air-fuel ratio correction coefficient KO2 set in accordance with the feedback control which is effected over a predetermined time period after the engine enters the region III. XLS3 (e.g. 0.80) is a mixture-leaning coefficient. KO2 calculated by the equation (2) is applied as KO2LLM, as explained later, KO2LLM being set to such a value as to attain an optimal air-fuel ratio (e.g. 18.0) to improvement of fuel consumption and emission characteristics while the engine is in the region III.

Figure 6:
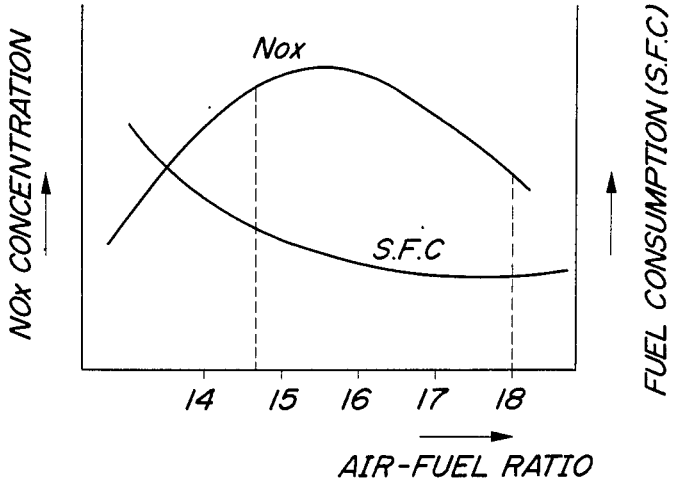
FIG. 6 is a graph showing NOx concentration and fuel consumption plotted with respect to air-fuel ratio.

Referring to FIG. 6, the relationship between NOx concentration and air-fuel ratio, and that between fuel consumption (S.F.C.) and air-fuel ratio will now be explained. It is seen from the figure that the NOx concentration becomes maximum when the air-fuel ratio becomes slightly leaner than 14.7 (at which the conversion efficiency of the three-way catalyst 14 in FIG. 1 becomes maximum), and as the air-fuel ratio is further leaned the NOx concentration decreases. It is clearly seen from FIG. 6 that the optimum value of air-fuel ratio that causes both NOx concentration and fuel consumption to be low and at the same time does not impair driveability is 18.0. Therefore, it is possible to improve fuel consumption without causing NOx concentration to increase during low-load high speed cruising, if the mixture-leaning coefficient XLS3 is set to such an appropriate value as to obtain a target value KO2LLM of the air-fuel ratio correction coefficient KO2 that makes the air-fuel ratio to be 18.0.

The average value KO2AVEn as of a present pulse of the TDC signal is obtained by the following equation:

$$KO2AVEn = \frac{LREF}{256} \times KO2p + \frac{256 - LREF}{256} \times KO2AVEn - 1 \quad (3)$$

where LREF represents an averaging variable which is set to an integer suitably selected from 1 through 256; KO2p is a value assumed by KO2 either immed-iately before or after setting of KO2 value by the proportional term (P term) control according to which the O2 feedback coefficient KO2 is increased or added by a fixed value each time the output of the O2 sensor 15 changes across a predetermined value from the rich side to the lean side or vice versa; KO2AVEn−1 represents the average value of KO2 as of the immediately preceding pulse of the TDC signal.

Incidentally, when the engine is in a feedback control region lying outside the mixture-leaning operating regions I, II, III, the air-fuel ratio of the mixture is controlled in closed loop mode, i.e. in a feedback manner responsive to the air-fuel ratio correction coefficient KO2, which varies with the output signal from the O2 sensor 15, such that the air-fuel ratio is controlled to a stoichiometric mixture ratio. On this occasion the mixture-leaning coefficient KLS is set to 1.0.

Figure 4:
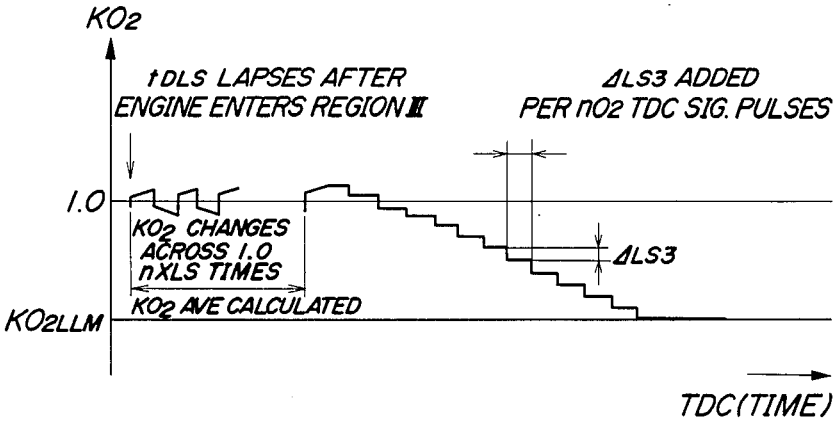
FIG. 4 is a graph showing an example of manner of calculating an air-fuel ratio correction coefficient KO2 in accordance with the method of the invention.
Figures 5, 5A:
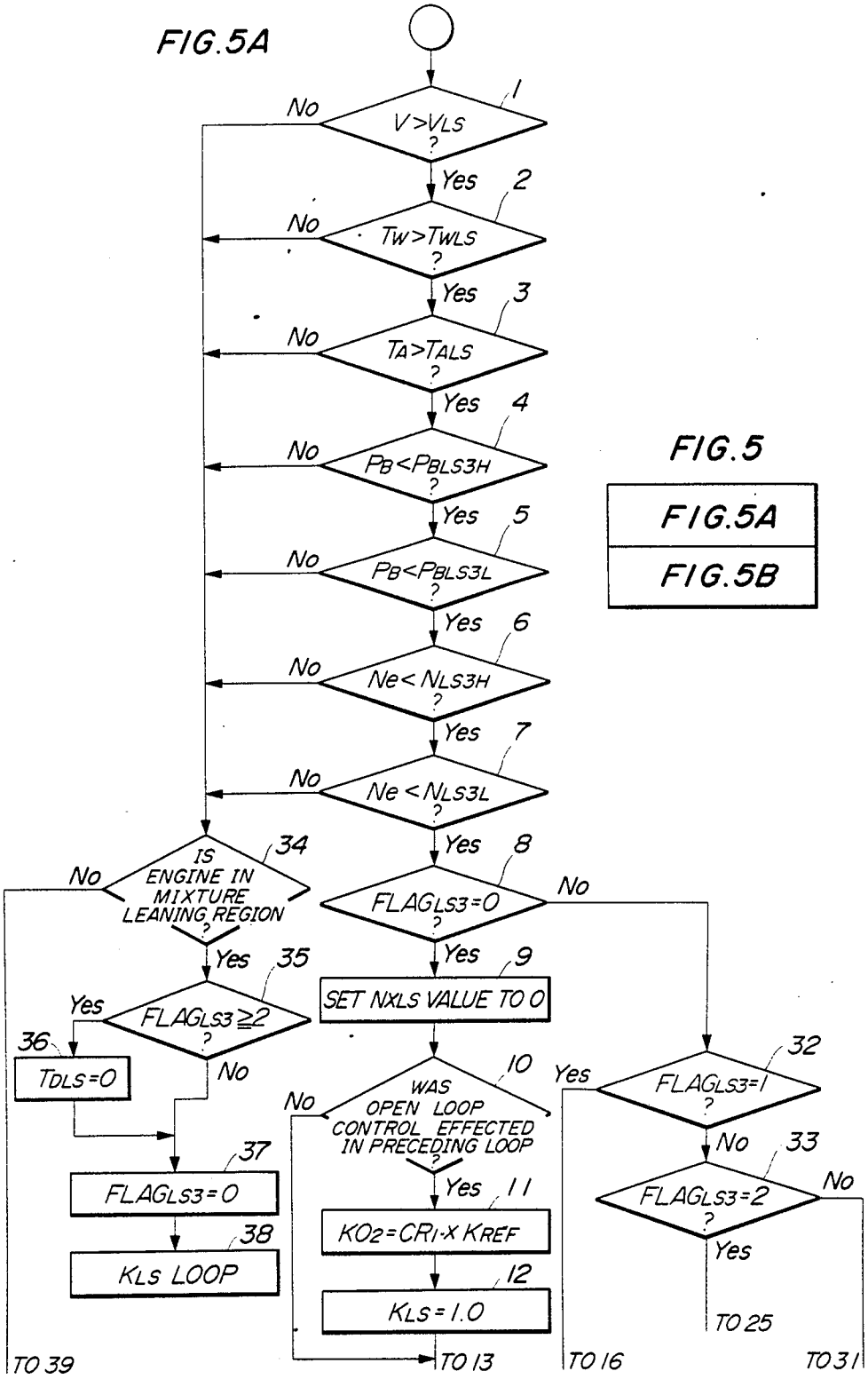
FIG. 5 is a flowchart of a program of executing the air-fuel ratio control method according to the invention.
Figure 5B:
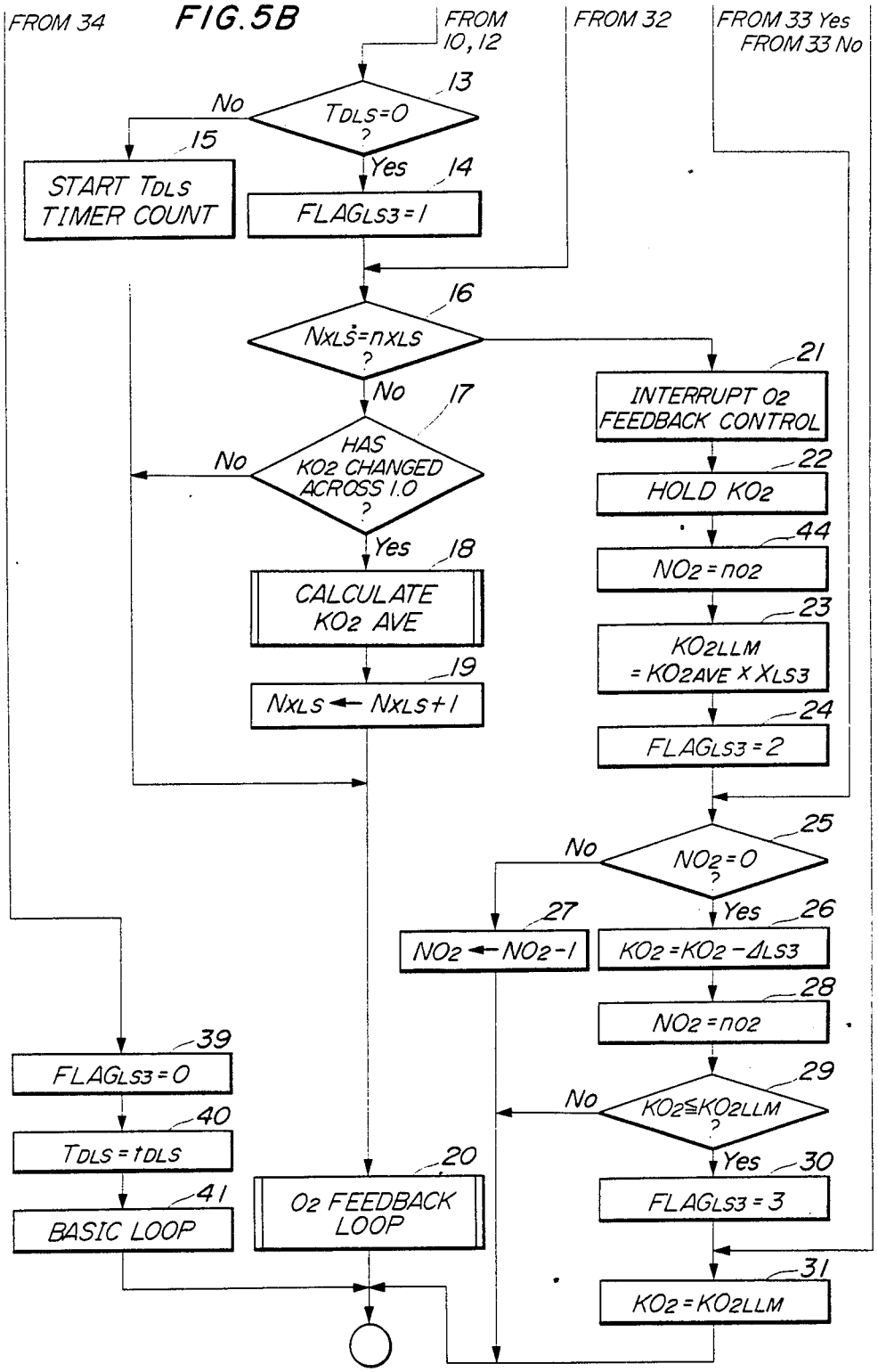

Referring now to FIG. 4 showing variation of the coefficient KO2 and FIG. 5 showing a flow chart of a program executed in synchronism with every TDC signal pulse, the air-fuel ratio control method according to the invention will be explained.

First, steps 1 through 7 in FIG. 5 determine whether or not the engine is operating in the region III (FIG. 3). More specifically, step 1 determines whether the vehicle speed V is higher than a predetermined value VLS (e.g. 45 km/h), and step 2 whether the engine coolant temperature TW is higher than a predetermined value TWLS (e.g. 70° C.). The step 1 is intended to reduce the NOx concentration during cruising on a superhighway where the vehicle speed is normally higher than 45 km/h, by leaning the mixture at vehicle speeds above 45 km/h. Step 2 is intended to improve the engine driveability by preventing leaning of the mixture when the engine is cold (before engine warming is completed). Step 3 determines whether or not the engine intake air temperature TA is higher than a predetermined value TALS (e.g. 20° C.), for the purpose of preventing poor engine combustion caused by leaning of the mixture when the ambient temperature is low, and the resulting degraded driveability. Then, steps 4 and 5 determine whether or not the intake pipe absolute pressure PB satisfies the inequality PBLS3L<PB<PBLS3H, and steps 6 and 7 determine whether the engine rotational speed Ne satisfies the inequality NLS3L<Ne<NLS3H. If any one of the steps 1 through 7 provides a negative answer (No), the program proceeds to step 34 and its succeeding steps to effect air-fuel ratio control in the mixture-leaning regions I and II and other regions including the feedback control region, as described later. If, on the other hand, the questions of all the steps 1 through 7 are affirmatively answered, the engine is judged to be operating in the mixture-leaning region III, and then step 8 and its succeeding steps are executed to effect mixture-leaning control in the region III. More particularly, when the engine is determined to be in the region III, the program executes steps 8 through 31 as follows. The air-fuel ratio feedback control is executed for a predetermined time period TDLS (e.g. 0.5 seconds) after the engine enters the region III. And even after the elapse of the predetermined time period TDLS the feedback control is still continued until the output voltage VO2 of the O2 sensor 15 has changed across a predetermined value from the lean side to the rich side or vice versa a predetermined number of times nXLS, preferably the number of times NXLS the air-fuel ratio correction coefficient KO2 changes across 1.0 has reached the predetermined value nXLS (e.g. 10). During this feedback control following the lapse of the predetermined time period TDLS, the average value KO2AVE of the correction coefficient KO2 obtained during this feedback control is simultaneously calculated by the equation (3). Then, by placing the value of KO2AVE into the equation (2), KO2LLM is obtained, and this value KO2LLM is employed as the target value for the coefficient KO2 to reach while the engine is in the region III.

Once the coefficient KO2LLM is calculated, the value of KO2 is decreased by a predetermined value ΔLS3 each time a predetermined number nO2 of TDC signal pulses have been generated, as shown in FIG. 4, so that the value of KO2 gradually approaches the target value KO2LLM. By thus causing the KO2 value, which is set in response to the output signal of the O2 sensor 15, to gradually approach to the target value of KO2LLM instead of suddenly changing the KO2 value to the KO2LLM, it is possible to avoid a sudden change in engine torque attributable to sudden leaning of the mixture and hence to improve the driveability.

Reverting to FIG. 5, if steps 1 through 7 determine the engine to be operating in the region III, it is determined at step 8 whether or not a flag FLAGLS3 is equal to zero. If the flag FLAGLS3 is zero, it indicates that the engine is in a condition other than those indicated by other values (=2, 3) of the flag wherein the control is to be executed in the region III, as hereinafter described. If the answer to step 8 is Yes, the count value NXLS (the number of times the KO2 value has changed across the predetermined value between the lean side to the rich side) is reset to zero at step 9, and then it is determined at step 10 whether or not the immediately preceding loop was an open loop, i.e. whether or not the engine was in the mixture-leaning region I or II during the immediately preceding loop. If the answer is No, i.e. if the present loop is the first loop immediately after the engine has entered the mixture-leaning region III from the feedback control region, the program directly proceeds to step 13 whereat it is determined whether or not the predetermined time period TDLS has elapsed, i.e. whether or not the count value TDLS of the TDLS downcounter is zero. On the other hand, if the answer at step 10 is Yes, i.e. if the air-fuel ratio was controlled to be to a lean value appropriate to the region I or II during the immediately preceding loop, the product of the average value KREF of values of the coefficient KO2 assumed while the engine was in a feedback region by a mixture-enriching coefficient CR1 is employed as the initial value of the correction coefficient KO2 (step 11), and after setting the mixture-leaning coefficient KLS to 1.0 at step 12 the program proceeds to step 13.

If the answer to the question of step 13 is No, then the count value TDLS is reduced by one at step 15, and only the feedback control that is carried out immediately after the engine enters the region III is continued (step 20), and if the answer to the question of step 13 is Yes, the program proceeds to step 14, where FLAGLS3 is set to 1. FLAGLS3=1 means that the average value KO2AVE of values of the coefficient value KO2 assumed during the feedback control immediately after the engine enters the region III is being calculated. Then, at step 16 it is determined whether or not the number of times NXLS the KO2 value has changed across 1.0 has reached the predetermined value nXLS (e.g. 10). If the answer is No, it is then determined whether or not the KO2 value has changed across 1.0 (step 17). If the answer to the question of step 17 is Yes, the average value KO2AVE is calculated by the equation (3) (step 18), and after increasing the value of NXLS by one (step 19) the feedback control is continued (step 20). If the answer to the question of step 17 is No, i.e. if the KO2 value has not changed across 1.0, then only the feedback control specified by step 20 is continued without calculating KO2AVE.

In the next loop, since the flag FLAGLS3 has been set to 1 at step 14 in the immediately preceding loop, the answer to the question of step 8 will be No, and therefore the program proceeds to step 32, and than executes steps 16 through 20, wherein the average value KO2AVE is calculated at step 18. When this calculation has been conducted the predetermined number of times NXLS, i.e. the KO2 value has changed across 1.0 the predetermined number of times NXLS, then the feedback control is discontinued (step 21) (refer to FIG. 4), the KO2 value is held at the value then assumed (step 22), a predetermined TDC signal pulse count NO2 is reset to a predetermined value nO2 which is set at 4 if the control is applied to a four stroke cycle engine (step 44), and the air-fuel ratio correction value value KO2LLM is calculated by the equation (3) (step 23). At step 24 the flag FLAGLS3 is set to 2. FLAGLS3=2 means that the KO2 value is being decreased by a fixed value ΔLS3.

In order that the KO2 value is decreased by ΔLS3 each time the predetermined number nO2 of the TDC signal pulses have been generated, it is determined at step 25 whether or not the count value NO2 is zero. If the answer is No, the count value NO2 is reduced by one (step 27) and then the program is terminated. If the answer is Yes, then the KO2 value is decreased by ΔLS3 (step 26), and NO2 is reset to nO2 (step 28). It is then determined whether or not the KO2 value has been decreased to a value smaller than or equal to KO2LLM (step 29). If the answer is No, the program is terminated. Thereafter, until KO2≦KO2LLM is satisfied, the program will repeatedly execute steps 33, 25, 28, and 29. When the KO2 value has been decreased to KO2LLM, then FLAGLS3 is set to 3 to indicate that the equality KO2=KO2LLM is established (step 30), and the coefficient KO2 is set to the target value KO2LLM (step 31). Then, the target value KO2LLM is substituted for KO2 in the equation (1) to thereby calculate the fuel injection period TOUT. In this way, the air-fuel ratio is controlled to the final lean value appropriate to the region III. By virtue of the above described air-fuel ratio control in the region III, the engine can be operated in a low-load high-speed cruising condition with reduced fuel consumption and without a degration in the driveability, while controlling the air-fuel ratio to a value at which the NOX concentration is much smaller than the maximum level.

Incidentally, since the KO2 value has been set to KO2LLM at step 31 with the flag FLAGLS3 set to 3 as noted above, the step 33 in the next loop will provide a negative answer (No) whereby the equality KO2=-KO2LLM is maintained.

Next, the control manner according to steps 34 through 41 will be explained, which steps are executed when the engine is determined not to be operating in the mixture-leaning region III. First, at step 34 it is determined whether or not the engine is operating in another mixture-leaning region, i.e. in the region I or II. If the answer is Yes, the program proceeds to step 35 to determine whether or not the present value of FLAGLS3 is 2 or greater, i.e. whether or not the engine was in the mixture-leaning region III and was controlled in an open loop manner during the immediately preceding loop. If the answer is Yes, the program proceeds to step 36 to set the count value TDLS of the TDLS timer to zero and then proceeds to step 37, while if the answer is No, the program directly goes to step 37 skipping step 36. At step 37 the flag FLAGLS3 is set to zero and thereafter the air-fuel ratio is leaned in an open loop manner (KLS Loop) (step 38). In the step 38 the mixture-leaning coefficient KLS is set to either one of the predetermined values XLS1 and XLS2, depending on whether the engine is operating in the mixture-leaning region I or II. If the answer at step 34 is No, it is judged that the engine is operating in a region other than the mixture-leaning regions I, II, III, and then the program executes step 39 to set FLAGLS3 to zero and execute step 40 to set the count value TDLS of the TDLS timer to the predetermined time period tDLS (e.g. 0.5 seconds). Thereafter step 41 is executed so that the air-fuel ratio is controlled to a value appropriate to the other region in which the engine is operating.

The reason for setting the count value TDLS of the TDLS timer to zero at step 36 is to prohibit at steps 13 and 15 the calculation of the average value KO2AVE for the predetermined time period TDLS after. the engine enters the region III, when the engine enters the region III from a region other than the mixture leaning regions I, II, III, e.g. the feedback operating region directly or by way of the region I or II, while the reason for resetting the value TDLS to the value tDLS is to immediately execute the calculation of the average value KO2AVE at steps 17 through 19 when if the engine temporarily enters the region I or II from the region III and then returns to the region III.

As explained above, according to the method of the present invention, when the engine enters the mixture-leaning region III (FIG. 3) which corresponds to a low-load high speed cruising condition, the air-fuel ratio is initially controlled in feedback manner alone for the predetermined time period TDLS, and after the lapse of the time period TDLS, while the feedback control is continued, the target value KO2LLM of the coefficient KO2 to be applied in the region III is obtained by multiplying the average value KO2AVE of the coefficient KO2, which is determined in response to the output signal from the O2 sensor 15, by the mixture-leaning coefficient XLS3, so that the air-fuel ratio of the mixture is accurately controlled to a desired lean value (e.g. 18.0) appropriate to the region mixture-leaning region III while the engine is in the region III, whereby the driveability and emission characteristics are improved, respectively, at transition to the low-load high speed cruising and during same.

What is claimed is:

1. A method of effecting feedback control of the air-fuel ratio of an air-fuel mixture being supplied to an internal combustion engine having an exhaust passage and means arranged in said exhaust passage for detecting the concentration of an exhaust gas ingredient, by correcting a basic fuel supply quantity by the use of a correction coefficient variable in value in response to an output from said means for detecting the exhaust gas ingredient concentration, when said engine is operating in a feedback control region, the method comprising the steps of: (1) providing a low-load operating region of said engine lying outside said feedback control region and defined by at least one parameter representing load on said engine; (2) determining, when the engine enters said low-load operating region, a value of said correction coefficient in response to the output from said means for detecting the exhaust gas ingredient concentration and also calculating an average value of values of said correction coefficient thus determined, for a predetermined period of time after the engine enters said low-load operating region; (3) calculating a target value of said correction coefficient on the basis of the average value obtained in said step (2), said target value yielding a predetermined air-fuel ratio leaner than a stoichiometric mixture ratio; (4) varying the value of said correction coefficient after the lapse of said predetermined period of time and until it becomes equal to said target value while the engine remains in said low-load operating region; and (5) correcting said basic fuel supply quantity by the use of the value of said correction coefficient thus varied.

2. A method as claimed in claim 1, wherein in said step (2) the air-fuel ratio is controlled in a feedback manner responsive to the value of said correction coefficient determined at said step (2) in response to the output from said means for detecting the exhaust gas ingredient concentration, and at the same time the average value of said correction coefficient is calculated.

3. A method as claimed in claim 1, wherein in said step (4) the value of said correction coefficient is gradually decreased until it becomes equal to said target value.

4. A method as claimed in claim 3, wherein the value of said correction coefficient is decreased by a fixed value each time a predetermined number of pulses of a signal representing predetermined crank angles of said engine are generated until the value of said correction coefficient becomes equal to said target value.

5. A method as claimed in claim 4, wherein said predetermined number of said signal pulses corresponds to the number of cylinders of said engine.

6. A method as claimed in claim 1 or claim 2, wherein the calculation of the average value of said correction coefficient at said step (2) is started when a second predetermined period of time has elapsed since the engine enters said low-load operating region.

7. A method as claimed in claim 6, wherein the air-fuel ratio is controlled in a feedback manner responsive to the value of said correction coefficient determined based on the output from said means for detecting the exhaust gas ingredient concentration for said second predetermined period.

8. A method as claimed in claim 1, wherein said steps (2) through (5) are executed when engine coolant temperature and engine intake air temperature are higher than respective predetermined values.

9. A method as claimed in claim 1, wherein said predetermined low-load operating region is a low-load high speed operating region wherein the speed of a vehicle in which the engine is installed is higher than a predetermined value.

* * * * *